US007523512B1

(12) United States Patent
Delaney et al.

(10) Patent No.: US 7,523,512 B1
(45) Date of Patent: Apr. 28, 2009

(54) SYSTEM AND METHOD FOR CLEANING RESTROOMS

(75) Inventors: Robert E. Delaney, Kennett Square, PA (US); Andrew K. Delaney, West Chester, PA (US); Bentley F. Gleeson, Plymouth Meeting, PA (US); Minh Q. Le, Fairfax, VA (US)

(73) Assignee: Gamajet Cleaning Systems, Inc., Exton, PA (US)

( * ) Notice: Subject to any disclaimer, the term of this patent is extended or adjusted under 35 U.S.C. 154(b) by 585 days.

(21) Appl. No.: 11/061,326

(22) Filed: Feb. 18, 2005

(51) Int. Cl.
*A47K 4/00* (2006.01)
*A47K 1/01* (2006.01)

(52) U.S. Cl. ..... 4/662; 4/223

(58) Field of Classification Search ..... 4/662, 4/223, 222; 15/321, 322
See application file for complete search history.

(56) References Cited

U.S. PATENT DOCUMENTS

| | | | | |
|---|---|---|---|---|
| 1,658,645 | A | 2/1928 | McGee | 239/288 |
| 2,605,478 | A * | 8/1952 | Lassiter | 4/662 |
| 3,150,399 | A | 9/1964 | Dick et al. | 15/246.5 |
| 3,326,468 | A | 6/1967 | Bristow et al. | 239/227 |
| 3,491,379 | A | 1/1970 | Parrish | 366/251 |
| 3,535,713 | A | 10/1970 | Helke et al. | 4/317 |
| 3,637,138 | A | 1/1972 | Rucker | 239/227 |
| 3,742,520 | A | 7/1973 | Bernardi | 4/662 |
| 3,791,393 | A | 2/1974 | Baldwin | 134/167 R |
| 3,969,133 | A | 7/1976 | McTighe et al. | 134/21 |
| 4,183,105 | A * | 1/1980 | Womack | 4/300 |
| 4,214,705 | A | 7/1980 | Watts et al. | 239/227 |
| 4,345,343 | A | 8/1982 | Shipman | 4/662 |
| 4,664,720 | A | 5/1987 | Rucker | 134/22.1 |
| 5,012,976 | A | 5/1991 | Loberg | 239/227 |
| 5,076,307 | A | 12/1991 | Harrington | 134/166 R |
| 5,096,122 | A | 3/1992 | Abramoska | 239/252 |
| 5,169,069 | A | 12/1992 | Rucker et al. | 239/227 |
| 5,172,710 | A | 12/1992 | Harrington | 134/167 R |
| D341,414 | S | 11/1993 | Baker | D23/310 |
| 5,299,767 | A | 4/1994 | Simpson | 248/129 |
| 5,316,218 | A | 5/1994 | Bowen | 239/246 |
| 5,332,155 | A | 7/1994 | Jager | 239/240 |
| 5,640,983 | A | 6/1997 | Sherman, Jr. et al. | 134/167 R |
| 5,647,090 | A | 7/1997 | Yang | 15/322 |
| 5,947,387 | A | 9/1999 | Zink et al. | 239/227 |
| 5,954,271 | A | 9/1999 | Le | 239/227 |
| 6,123,271 | A | 9/2000 | Delaney et al. | 239/227 |
| 6,206,980 | B1 | 3/2001 | Robinson | 134/21 |
| 6,227,460 | B1 | 5/2001 | Funk et al. | 239/131 |
| 6,234,409 | B1 | 5/2001 | Aslakson | 239/172 |
| 6,539,962 | B2 | 4/2003 | Paper et al. | 134/169 R |
| 6,561,199 | B2 | 5/2003 | Gleeson et al. | 134/22.18 |
| 6,789,552 | B1 | 9/2004 | Robinson et al. | 134/22.18 |
| 6,896,742 | B2 * | 5/2005 | Geyer et al. | 134/21 |
| 2003/0015603 | A1 | 1/2003 | Schreur et al. | 239/227 |

* cited by examiner

*Primary Examiner*—Huyen Le
(74) *Attorney, Agent, or Firm*—Michael R. Philips

(57) ABSTRACT

A preferred embodiment of a system for cleaning a restroom includes a pump for pressurizing a fluid, and a spray device in fluid communication with the pump. The spray device has a nozzle for discharging a stream of the fluid. The system also includes a stand for supporting the spray device within an enclosure of the restroom while the spray device discharges the stream at an interior surface of the enclosure, and a cover for suspending the spray device in a holding tank of the restroom while the spray device discharges the stream at an interior surface of the holding tank.

10 Claims, 10 Drawing Sheets

SYSTEM AND METHOD FOR CLEANING RESTROOMS

FIELD OF THE INVENTION

The present invention relates generally to cleaning systems. More specifically, the invention relates to a system and a method for cleaning a restroom facilities, including portable restroom facilities such as "porta-potties."

BACKGROUND OF THE INVENTION

Portable or temporary restroom facilities are commonly used at outdoor events, construction sites, camp grounds, or other locations where the construction of permanent facilities may not be practical or cost-effective, or where the existing facilities are not sufficient. Portable or temporary restroom facilities usually include, at a minimum, a four-sided enclosure with an access door; a holding tank for waste; and a toilet in the form of a platform and seat with access to the holding tank. This type of restroom facility is commonly referred to as a "porta-potty."

A portable or temporary restroom facility requires periodic cleaning, the frequency of which depends on the amount of use of the facility. Cleaning is often performed on-location, using a specially-configured truck commonly referred to as a "vacuum truck." The vacuum truck evacuates the waste in the holding tank of the restroom facility into a specially-configured tank on the vacuum truck, so that the waste can be transported to and disposed of at a suitable waste-treatment facility. Alternatively, the restroom facility can be transported to another location, such as a centralized cleaning facility at the owner's place of business, and emptied and cleaned at that location.

A typical cleaning process also includes rinsing the interior surfaces of the holding tank and the enclosure using a hand-held spray device such as a spray gun, wand, or nozzle. The spray device directs a pressurized stream of cleaning fluid, such as water or a mixture of water and detergent, at the interior surfaces. The cleaning process can further include scrubbing the interior surfaces using a brush or other suitable device.

Rinsing and scrubbing the restroom facility can be messy, unpleasant, and potentially unhealthy for the laborer performing these tasks. For example, contact with overspray and splashing of the cleaning fluid and residual waste can pose a health hazard to the laborer, and potentially can place the employer in violation of various safety and environmental regulations.

Moreover, the need for the laborer to insert the hand-held spray device into the holding tank, and to manipulate the device to spray the interior surfaces of the holding tank can further increase the potential for exposure to residual waste. Also, it may be difficult or impractical to effectively rinse the interior surface of the holding tank in its entirety using a hand-held spray device.

The above-noted drawbacks can make it difficult to adequately clean portable or temporary restroom facilities on a consistent basis. Hence, the users of such facilities are often confronted with an unsanitary and potentially unhealthy facility. Moreover, the owner or operator of the restroom facility may compensate for the unsanitary or unhealthy conditions by using excessive amounts of disinfectant, potentially exacerbating the health hazard and the unpleasant odors associated with the facility.

SUMMARY OF THE INVENTION

A preferred embodiment of a system for cleaning a restroom comprises a pump for pressurizing a fluid, and a spray device in fluid communication with the pump. The spray device comprises a nozzle for discharging a stream of the fluid. The system also comprises a stand for supporting the spray device within an enclosure of the restroom while the spray device discharges the stream at an interior surface of the enclosure, and a cover for suspending the spray device in a holding tank of the restroom while the spray device discharges the stream at an interior surface of the holding tank.

A preferred embodiment of a kit for cleaning a restroom comprises a pumping device, a spray device, and tubing for directing fluid from the pumping device to the spray device. The kit also comprises a cover capable of being installed over an opening in a holding tank of the restroom and supporting the spray device in the holding tank, and a stand capable of being placed on a surface within an enclosure of the restroom and supporting the spray device within the enclosure.

A preferred method for cleaning a restroom comprises mounting a spray device on a stand, placing the stand within an enclosure of the restroom, and directing a stream of pressurized fluid at an interior surface of the enclosure using the spray device. The method also comprises suspending the spray device within a holding tank of the restroom, and directing another stream of pressurized fluid at an interior surface of the holding tank using the spray device.

Another preferred method for cleaning a restroom comprises providing a pump and a spray device, placing the spray device in at least one of a holding tank and an enclosure of the restroom, and pumping fluid from the pump to the spray device so that the spray device directs a rotating stream of the fluid at an interior surface of the at least one of a holding tank and an enclosure of the restroom.

BRIEF DESCRIPTION OF THE DRAWINGS

The foregoing summary, as well as the following detailed description of a preferred embodiment, are better understood when read in conjunction with the appended diagrammatic drawings. For the purpose of illustrating the invention, the drawings show an embodiment that is presently preferred. The invention is not limited, however, to the specific instrumentalities disclosed in the drawings. In the drawings.

DETAILED DESCRIPTION OF PREFERRED EMBODIMENTS

FIGS. 2 to 9 depict a preferred embodiment of a system 10 for cleaning a restroom facility 12, or various components of the system 10. The system 10 is described in connection with a specific type of restroom facility for exemplary purposes only, as the system 10 and the corresponding cleaning method described herein can be used to clean other types of restroom facilities.

Figure 1:
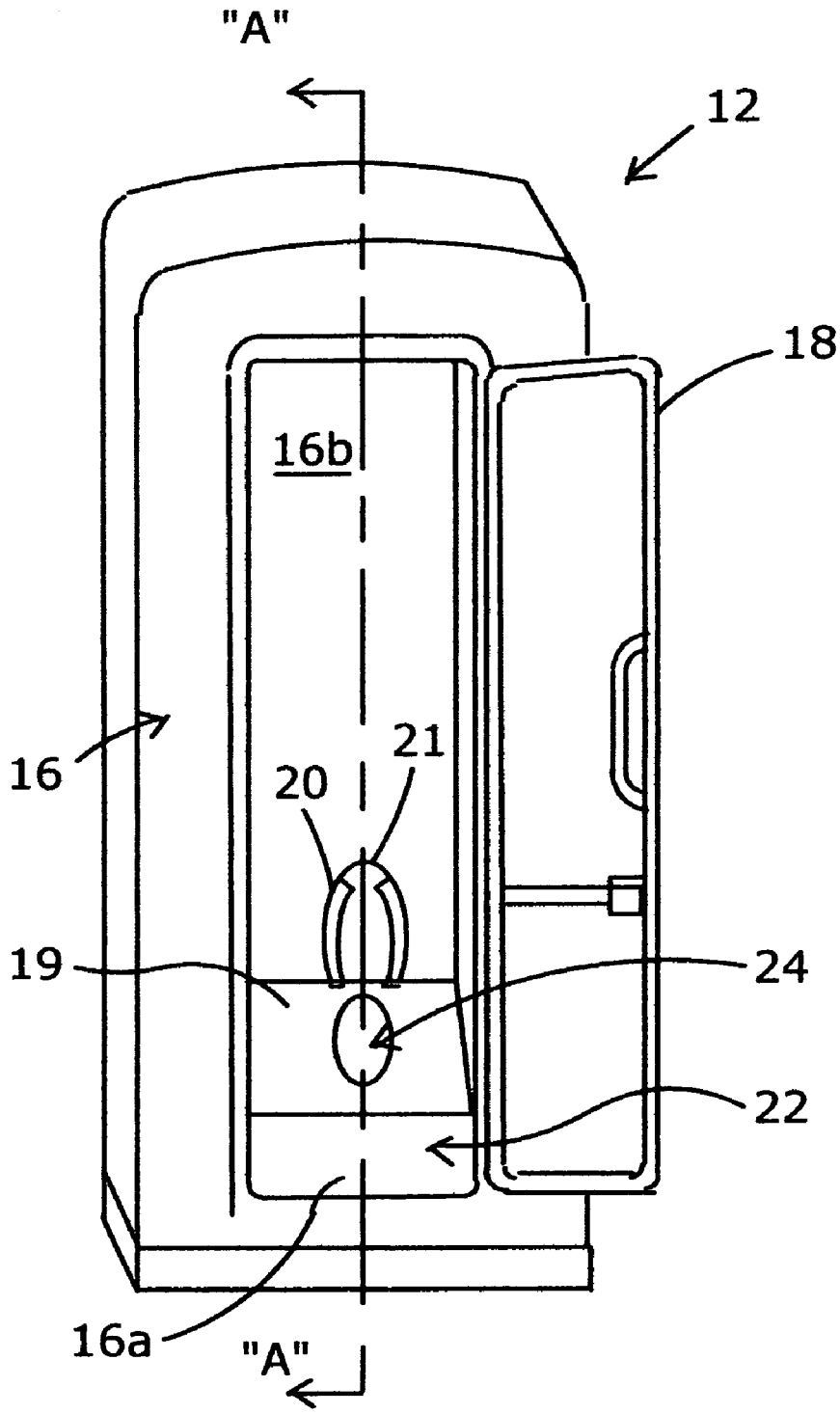
FIG. 1 is a perspective view of a portable restroom.
Figure 6:
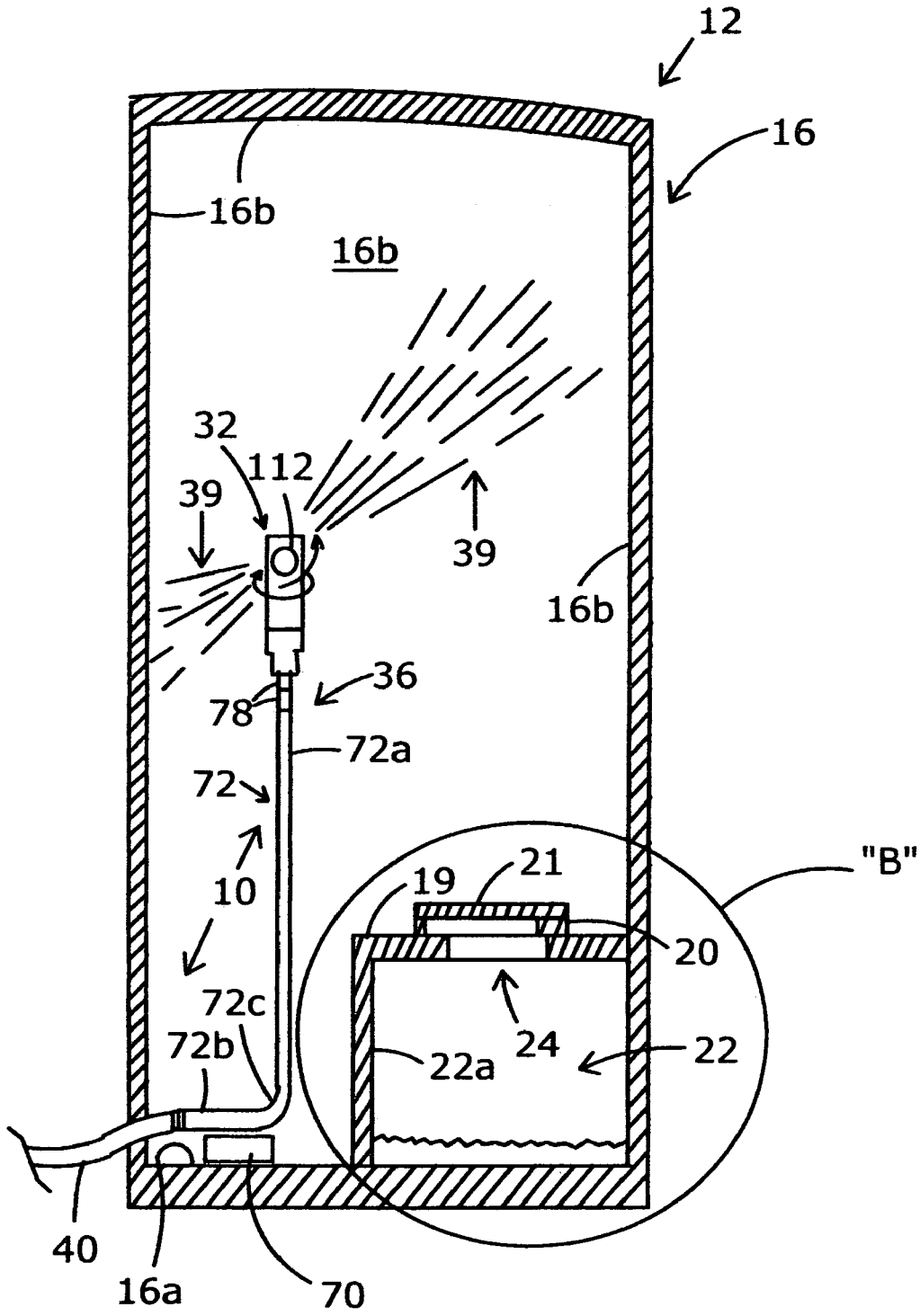
FIG. 6 depicts the system shown in FIG. 2, in use cleaning an interior of an enclosure of the portable restroom shown in FIGS. 1 and 2, and showing a cross-section of the restroom taken through the line "A-A" of FIG. 1.

Restroom facilities such as the restroom facility 12 are commonly referred to as "porta-potties." The restroom facility 12 includes a shell or enclosure 16 (see FIGS. 1 and 6). The enclosure 16 has a door 18 for providing access to the interior thereof. The restroom facility 12 also includes a platform 19, and a seat 20 and lid 21 mounted on the platform 19. The restroom facility 12 also includes a holding tank 22 located beneath the platform 19. The seat 20 and lid 21 can be raised and lowered between an "up" position (shown in FIGS. 1, 2, and 7) and a "down" position (shown in FIG. 6). An opening 24 is formed in the platform 19, below the seat 20, to provide the user with access to the holding tank 22.

The system 10 can be used to clean at least the holding tank 22, and the interior of the enclosure 16. The system 10 includes a pumping device 30, a spray device 32, a cover 34, and a stand 36.

Figure 5:
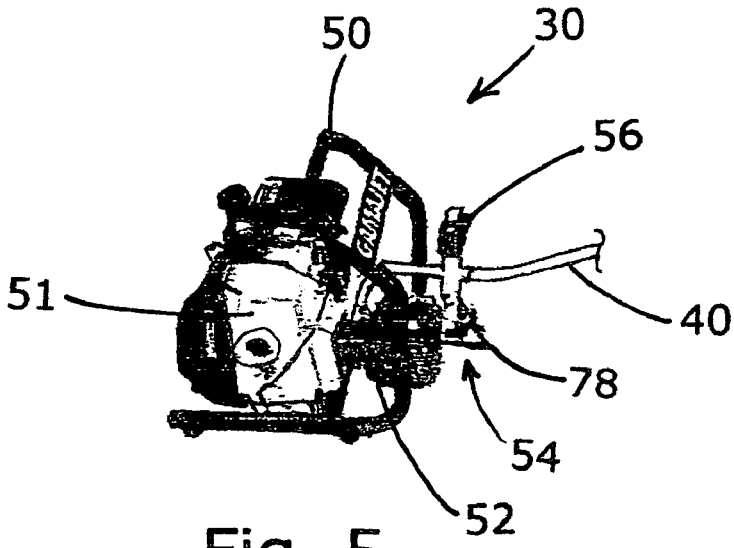
FIG. 5 depicts a pumping device of the system shown in FIG. 2.

The pumping device 30 provides pressurized fluid to the spray device 32 (see FIG. 5). The fluid can be, for example, water, or a mixture of water and detergent. The term "cleaning fluid" is used hereinafter to refer to this fluid.

Figure 3:
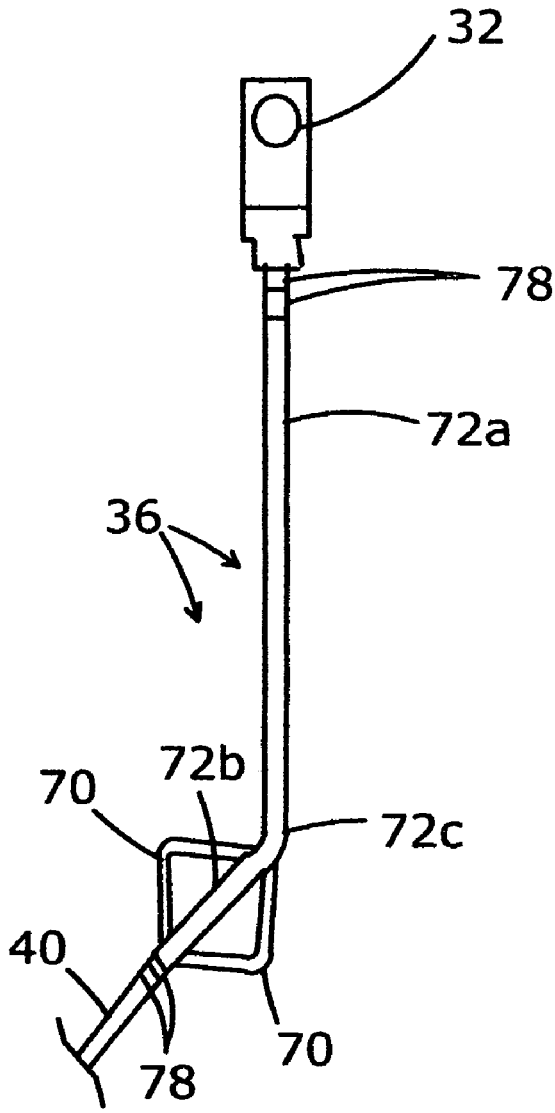
FIG. 3 depicts a stand of the system shown in FIG. 2.

The spray device 32 is mounted on the stand 36 during cleaning of the interior of the enclosure 16 (see FIGS. 3 and 6). The stand 36 can be placed on a floor 16*a* of the enclosure 16, and connected to the pumping device 30. The spray device 32 can be supplied with pressurized cleaning fluid from the pumping device 30 by way of the stand 36. The spray device 32 discharges the cleaning fluid in rotating streams 39 directed toward the floor 16*a*, and other interior surfaces 16*b* of the enclosure 16, thereby cleaning the floor 16*a* and the other interior surfaces 16*b*.

The spray device 32 can subsequently be removed from the stand 36 and mounted directly or indirectly on the cover 34 (see FIGS. 4 and 7). The cover 34 is placed over the holding tank 22 so that the spray device 32 is suspended within the holding tank 22. The spray device 32 can be supplied with pressurized cleaning fluid from the pumping device 30. The spray device 32 discharges the cleaning fluid in rotating streams 39 directed toward interior surfaces 22*a* of the holding tank 22, thereby cleaning the holding tank 22. The resulting mixture of residual waste and cleaning fluid preferably is drawn out of the holding tank 22 by a vacuum or other suitable means, as the cleaning fluid is introduced into the holding tank 22.

The holding tank 22 and the interior of the enclosure 16 can be cleaned in any order, although it is preferred that the interior of the enclosure 16 be cleaned prior to the holding tank 22. Moreover, the holding tank 22 should be substantially emptied of waste before the enclosure 16 and the holding tank 22 are cleaned.

Specific details concerning the cleaning of the enclosure 16 are as follows.

The stand 36 preferably comprises a base 70, and a tube 72. Preferably, the tube 72 is unitarily formed, and includes a first portion 72*a*, a second portion 72*b*, and a 90° bend 72*c* located between the first and second portions 72*a*, 72*b* (see FIGS. 3 and 6). The second portion 72*b* and the elbow 72*c* can be secured to the base 70 by a suitable means such as welding, fasteners, clamps, etc.

The spray device 32 is mounted on an upper end of the first portion 72*a* of the tube 72. The first portion 72*a* and the spray device 32 preferably are coupled by quick-disconnect fittings 78.

Directional terms such as "upper," "lower," "vertical," horizontal," "above," "below," etc., are used with reference to the component orientations depicted in FIGS. 6 and 7. These terms are used for exemplary purposes only, and are not intended to limit the scope of the appended claims.

The second portion 72*b* of the tube 72 receives pressurized cleaning fluid from the pumping device 30 by way of tubing. The tubing preferably is a flexible hose 40. The hose 40 preferably is coupled to the pumping device 30 and the second portion 72*b* by quick disconnect fittings 78.

The stand 36 is placed on the floor 16*a* of the enclosure 16. The spray device 32 and the hose 40 can be coupled to the stand 36 before or after the stand 36 is placed in the enclosure 16.

The door 18 of the enclosure 16 preferably is closed to the maximum extent possible before the pumping device 30 is activated (the need to run the hose 40 through the opening for the door 18 may prevent the door 18 from closing fully). Moreover, the seat 20 and the lid 21 preferably are placed in their respective "down" positions before the pumping device 30 is activated.

Preferably, the pumping device 30 produces a relatively high-pressure, low volume flow of cleaning fluid, to minimize runoff while maximizing cleaning effectiveness. For example, the pumping device 30 can pressurize the cleaning fluid to approximately 1,500 pounds per square inch, and can pump the cleaning fluid at a flow rate of approximately 4.5 gallons per minute. It should be noted that the optimal pressure and flow rate for the cleaning fluid are application dependent, and specific values are provided herein for exemplary purposes only.

A suitable commercially-available power washer can be used as the pumping device 30. The pumping device 30 can include, for example, a frame 50, a motor 51 mounted on the frame 50, a pump 52 driven by the motor 51, and a pressure regulator 54 for regulating the discharge pressure of the pump 52 (see FIG. 5). The motor 51 can be, for example, a five-horsepower, gasoline-operated engine, although other types of motors, including electric motors, can be used in the alternative.

Figure 2:
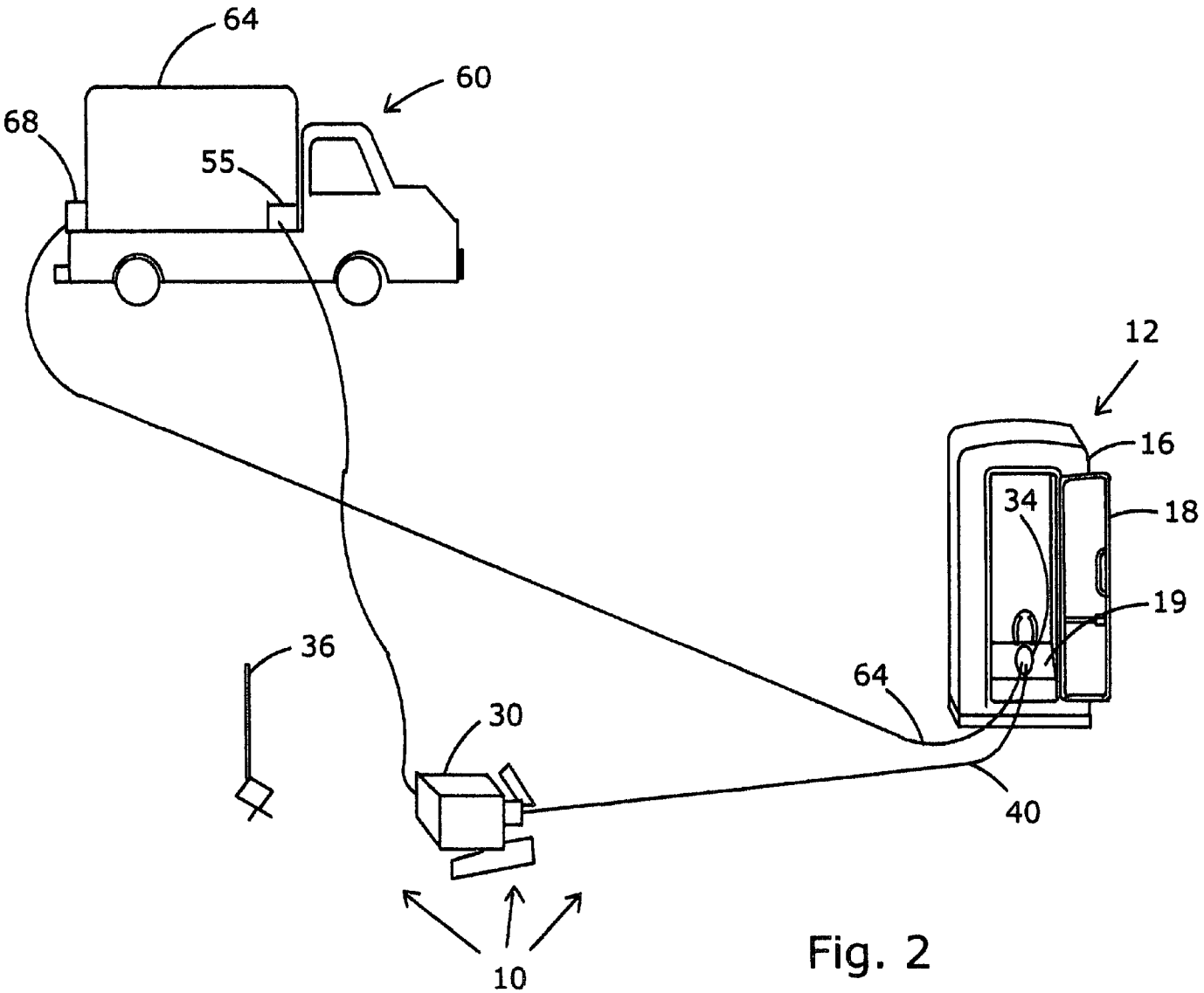
FIG. 2 depicts a preferred embodiment of a system for cleaning restrooms, in use cleaning a holding tank of the portable restroom shown in FIG. 1.

The pumping device 30 can draw clean water from a tank 55 on a vacuum truck 60 (as shown in FIG. 2), or from another suitable water source such as a faucet or well. The pumping device 30 can include a valve 56 that permits detergent to be mixed with the water, so that the cleaning fluid discharged by the pumping device 30 comprises a mixture of detergent and water.

The pumping device 30 discharges the pressurized cleaning fluid into the hose 40. The cleaning fluid subsequently flows through the second portion 72*b*, the elbow 72*c*, and the first portion 72*a* of the tube 72 of the stand 36. The cleaning fluid enters the spray device 32 from the first portion 72*a*.

The spray device 32 includes a stationary structure and a rotating structure. The stationary structure comprises the inlet housing 102, an upper stem 104, and a base 106 (see FIGS. 8-10). An inlet 114 is formed within the inlet housing 102, and forms one end of the spray device 32. The inlet 114 receives one of the quick-disconnect fittings 78 that couple the spray device 32 to the stand 36. The other end of the spray device 32 is formed by the base 106.

Figure 9:
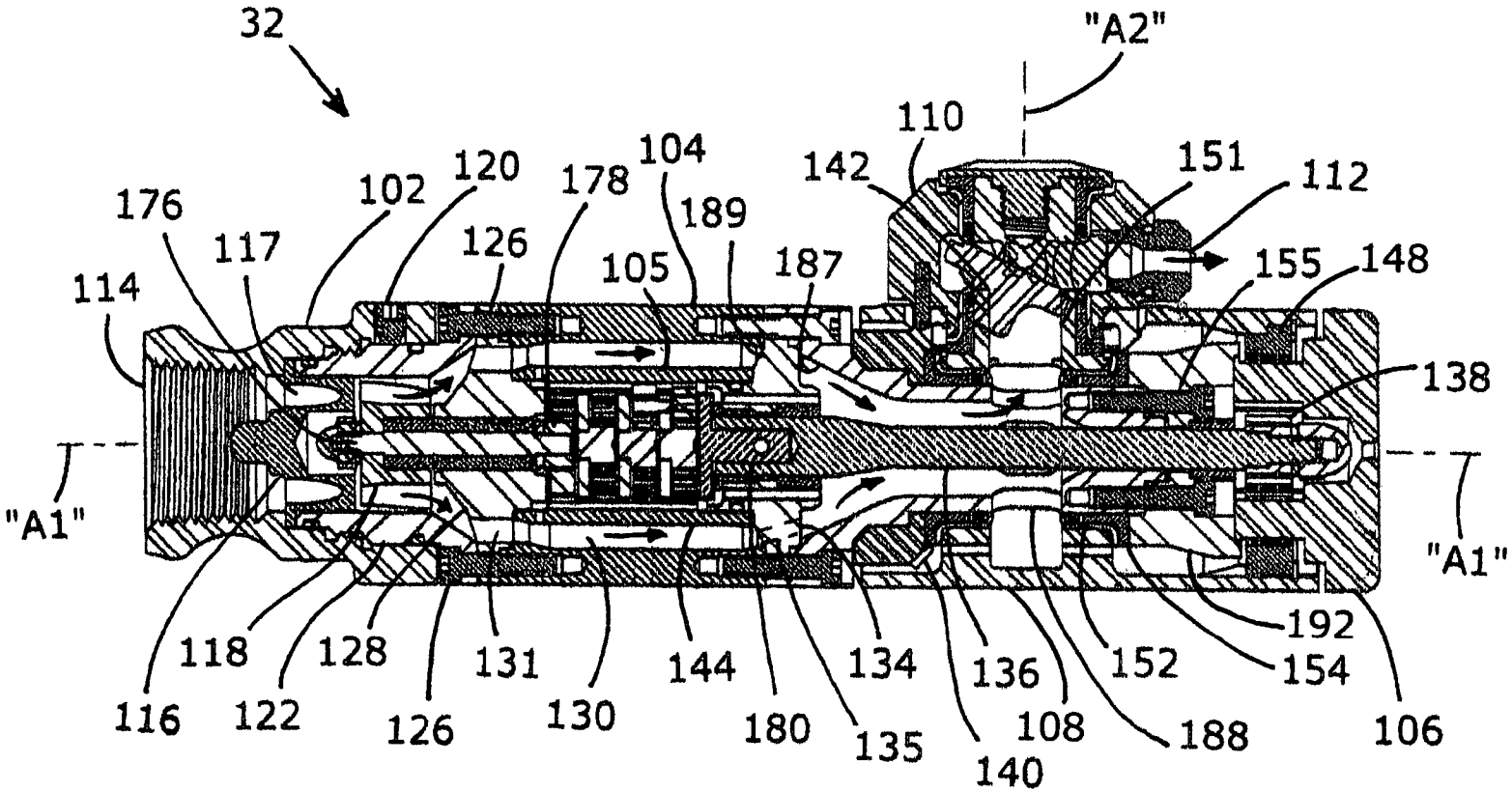
FIG. 9 is a cross-sectional view taken through the line "C-C" of FIG. 8.

The rotating structure of the spray device 32 comprises a rotating T-housing 108, and a nozzle housing 110 mounted on the T-housing 108. Two spray nozzles 112 are mounted on the nozzle housing 110, in a diametrically-opposed relationship (only one of the spray nozzles 112 is depicted in FIG. 9, for clarity).

The pressurized cleaning fluid is directed into the spray device 32 by way of the inlet 114. The fluid drives internal gearing that causes the T-housing 108 and the nozzle housing 110 to rotate about an axis labeled "A1" in FIGS. 8 and 9. The gearing also causes the nozzle housing 110 to rotate about an axis labeled "A2" in FIGS. 8 and 9. The axis A2 preferably is substantially perpendicular to the axis A1. The cleaning fluid is eventually ejected from the nozzles 112.

Further details of the spray device 32 are as follows. The inlet housing 102 is threaded onto a cap 122 of the upper stem 104, and is secured by means of a set screw 120 (see FIG. 9). The stem cap 122 is secured to the upper stem 104 by screws 126.

The T-housing 108 is mounted on front and rear bearings 152, 154. The front and rear bearings 152, 154 are mounted on a stem 187. The stem 187 is mounted on the upper stem 104 by screws 189. This arrangement enables the T-housing 108 to rotate about the respective centerlines of the upper stem 104 and the stem 187, which define the axis A1.

A stator 116 having disk-shaped passages 117 is mounted within the stem cap 122. The stator 116 swirls the incoming stream of cleaning fluid.

The cleaning fluid flows over an impeller 118 after exiting the stator 116. The cleaning fluid imparts sufficient torque to rotate an input drive shaft 176 on which the impeller 118 is mounted. An input pinion gear 178 mounted on the end of the input drive shaft 176 drives a planetary gear train 105. The planetary gear train 105 is enclosed within a housing formed by a front bearing housing 128, a cylindrical ring gear 144, and a rear bearing housing 134.

The planetary gear train 105 includes a planetary gear train output shaft 180 that drives an output drive shaft 136. The planetary gear train 105 provides a speed reduction that causes the output drive shaft 136 to rotate at a substantially lower speed than the impeller 118.

Figure 10:
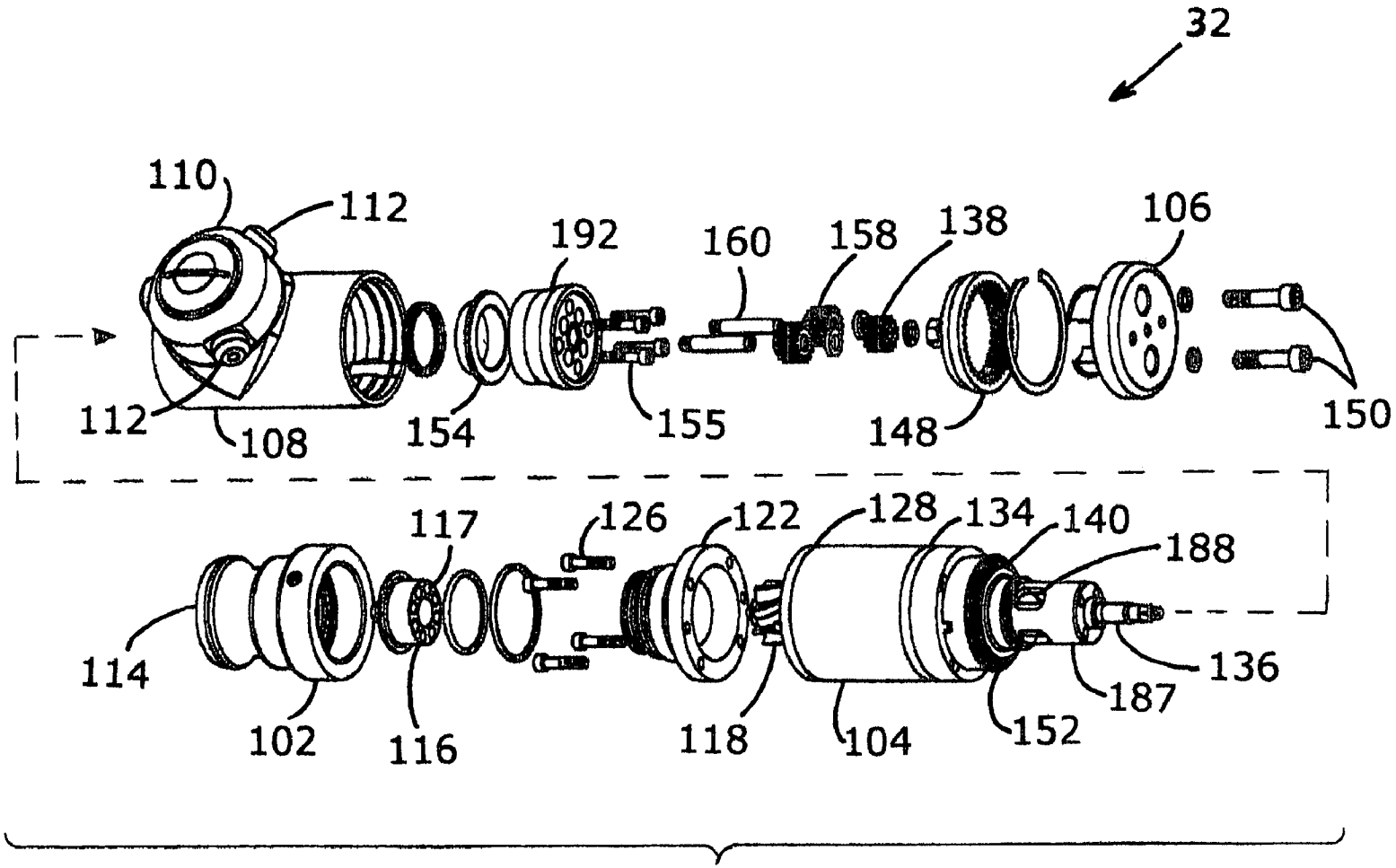
FIG. 10 is an exploded view of the spray device shown in FIGS. 8 and 9.

The output drive shaft 136 drives an output pinion gear 138 that, in turn, drives two idler gears 158 each mounted on a respective shaft 160 (see FIG. 10). The shafts 160 each extend between an idler shaft base 192 and the base 106. The idler shaft base 192 is secured to the stem 187 by screws 155. The base 106 is secured to the idler shaft base 192 by screws 150. The idler gears 158 drive a ring gear 148 retained within the T-housing 108. The ring gear 148 is fixed to the T-housing 108 by means of a key so that rotation of the ring gear 148 drives the T-housing 108. The idle gears 158 and the ring gear 148 provide additional speed reduction, and along with the planetary gear train 105 cause the T-housing 108 to rotate at a speed substantially less than that of the impeller 118.

A stationary bevel gear 140 is fixed to the stem 187. The stationary bevel gear 140 engages a bevel gear 142 fixed to the nozzle housing 110. Rotation of the T-housing 108 causes the stationary bevel gear 140 to drive the bevel gear 142, thereby causing the nozzle housing 110 to rotate about the axis A2. The gear ratio between the stationary bevel gear 140 and the bevel gear 142 preferably is slightly greater than 1:1, so that each 360° revolution of the T-housing 108 causes the nozzle housing 110 to rotate by approximately 366°.

The cleaning fluid, after flowing through the passages 117 of the stator 116 and over the impeller 118, flows through an annular passage 130. The initial portions of the passage 130 are formed by an annular region created between the stem cap 122 and the front bearing housing 128, and a plurality of holes 131 formed within the front bearing housing 128.

The intermediate portions of the passage 130 are formed by an annular region created between the ring gear 144 and the upper stem 104, and by holes 135 in the rear bearing housing 134.

The final portions of the passage 130 are formed by an annular region created between the output drive shaft 136 and the stem 187, four large openings 188 formed in the stem 187, a nose portion 151 of the T-housing 108, and openings in the nose portion 151. From the openings in the nose portion 151, the cleaning fluid flows radially outward through outlets in the nozzles 112.

The pressurized streams 39 of cleaning fluid ejected by each of the spray nozzles 112 is directed against the floor 16*a* and the other interior surfaces 16*b* of the enclosure 16. The configuration of the spray device 32 causes the rotating streams 39 to sweep through a predicable, repeatable pattern within the enclosure 16.

The impact of the streams 39 on the floor 16*a* and the other interior surfaces 16*b* of the enclosure 16 can loosen and remove dirt and other contaminates. (This cleaning technique is referred to as "rotary impingement cleaning.") Since the spray nozzles 112 rotate about both of the axes A1 and A2, the overall spray pattern produced by the spray nozzles 112 provides essentially 360° coverage around the spray device 32. It is believed that the cleaning fluid can be directed against approximately ninety-five percent of the surface area within the enclosure 16 when the spray device 32 is mounted as depicted in FIG. 6.

Further details concerning spray devices substantially similar to the spray device 32 can be found in U.S. Pat. Nos. 6,123,271 and 6,561,199. The contents of each of these patents is incorporated by reference herein in its entirety. Spray devices suitable for use as part of the system 10 can be obtained, for example, from Gamajet Cleaning Systems, Inc. of Devault, Pa.

It should be noted that specific details of the spray device 32 are presented for exemplary purposes only. Other types of spray devices, including devices comprising non-rotating nozzles and spray wands, can be used in the alternative.

Figure 12:
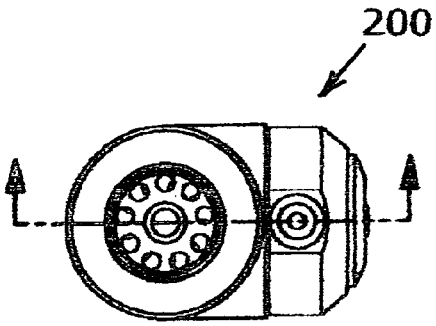
FIG. 12 is a front view of the spray device shown in FIG. 11.
Figure 11:
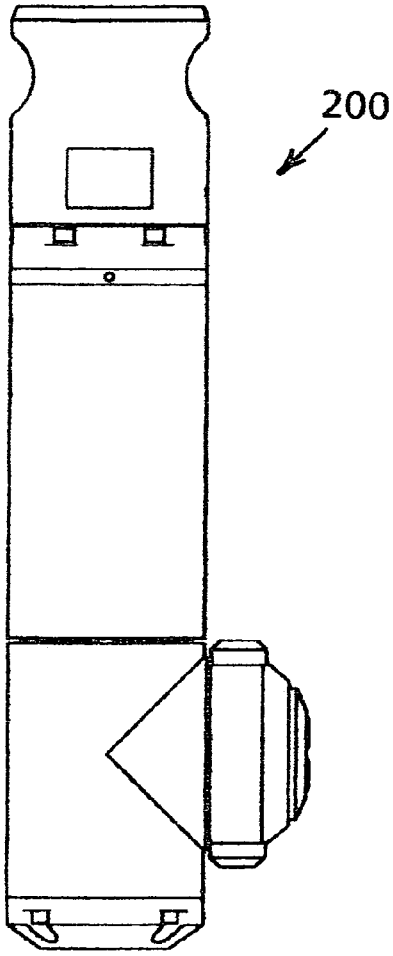
FIG. 11 is a side view of another spray device that can be used as part of the system shown in FIGS. 2, 6, and 7 in lieu of the spray device shown in FIGS. 8-10.
Figure 13:
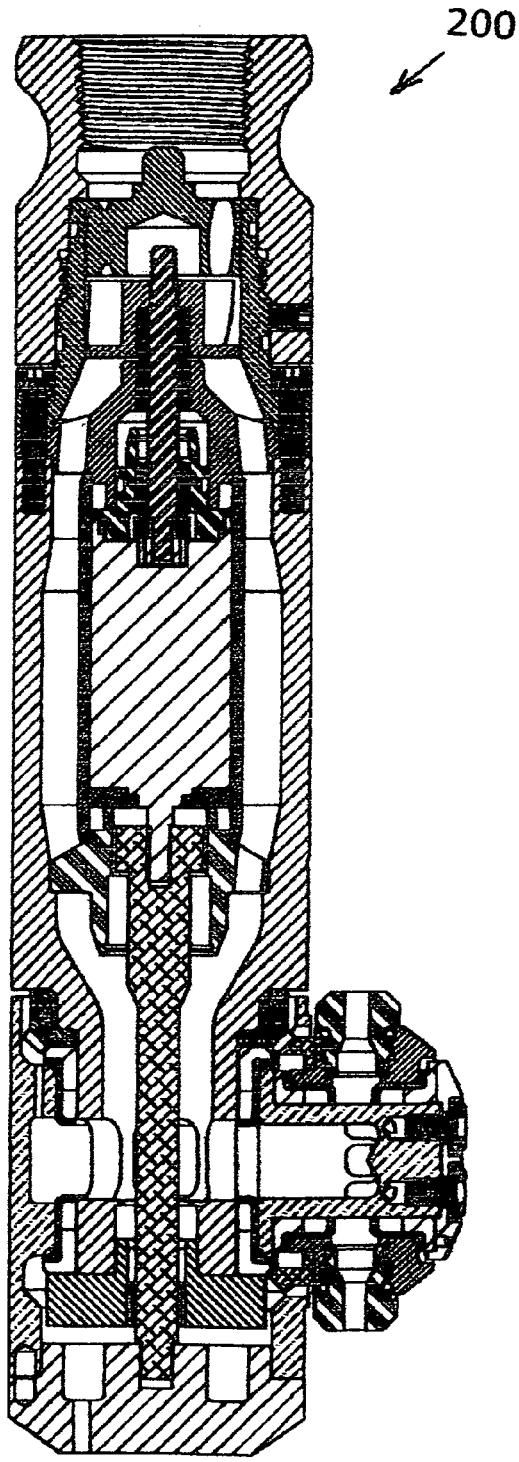
FIG. 13 is a cross-sectional view taken through the line "D-D" of FIG. 12.

For example, the spray device 32 relies on the cleaning fluid flowing therethrough to cool and lubricate the planetary gear train 105. Other types of spray devices which utilize grease as the lubricating and cooling medium can be used in the alternative. For example, FIGS. 10-12 depict a spray device 200 that uses grease as the lubricating and cooling medium for its gear train. The principle of operation of the device 200 is otherwise substantially similar to that of the spray device 32. A spray device such as the spray device 200 can be obtained from Gamajet Cleaning Systems, Inc. as the GAMAJET® IX vessel cleaning apparatus.

The above-described cleaning process for the enclosure 16 can be performed with no operator involvement once the stand 36 and the spray device 32 are placed in the enclosure 16, and the pumping device 30 is activated. Moreover, the cleaning process can performed while the door 18 of the enclosure 16 is closed, substantially reducing the potential for splashing or overspray of the cleaning fluid, residual waste, and runoff. Hence, the potential for the operator to be exposed to residual waste, or to the unpleasant and potentially unhealthy odors associated with the enclosure 16 prior to and during cleaning thereof, can be substantially reduced or eliminated when the enclosure 16 is cleaned in the above-described manner.

Specific details concerning the cleaning of the holding tank 22 are as follows.

Figure 4:
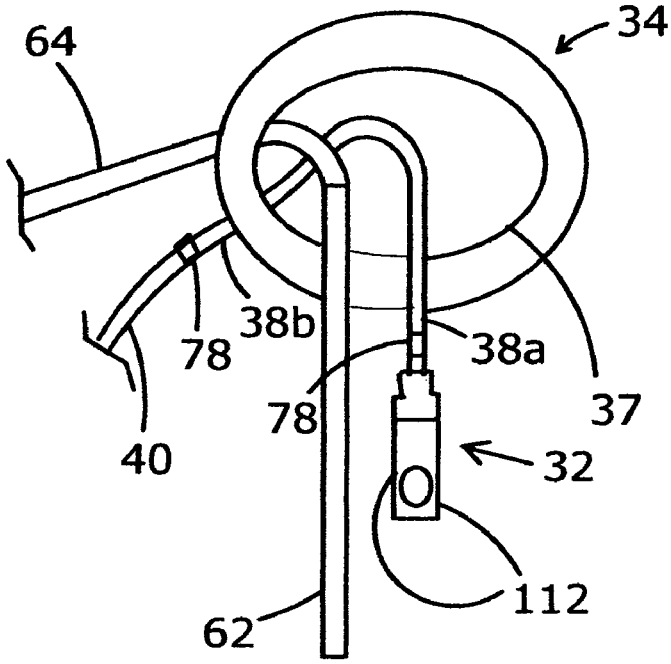
FIG. 4 depicts a cover, a spray device, a vacuum wand, and tubing of the system shown in FIG. 2.
Figure 7:
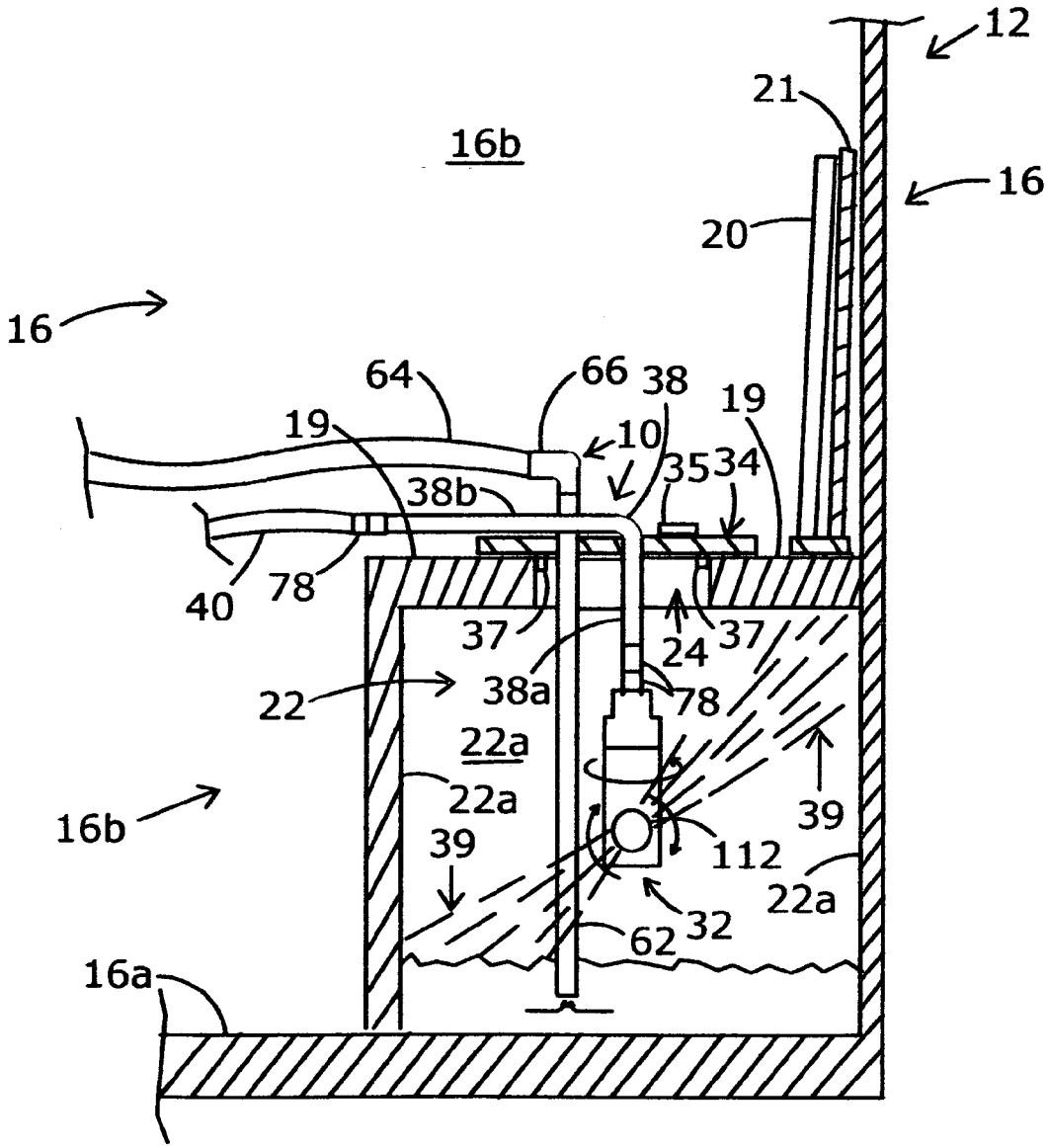
FIG. 7 depicts the system shown in FIGS. 2 and 6, in use cleaning the holding tank of the portable restroom shown in FIGS. 1, 2, and 6, and showing a magnified view of the area designated "B" in FIG. 6.
Figure 8:
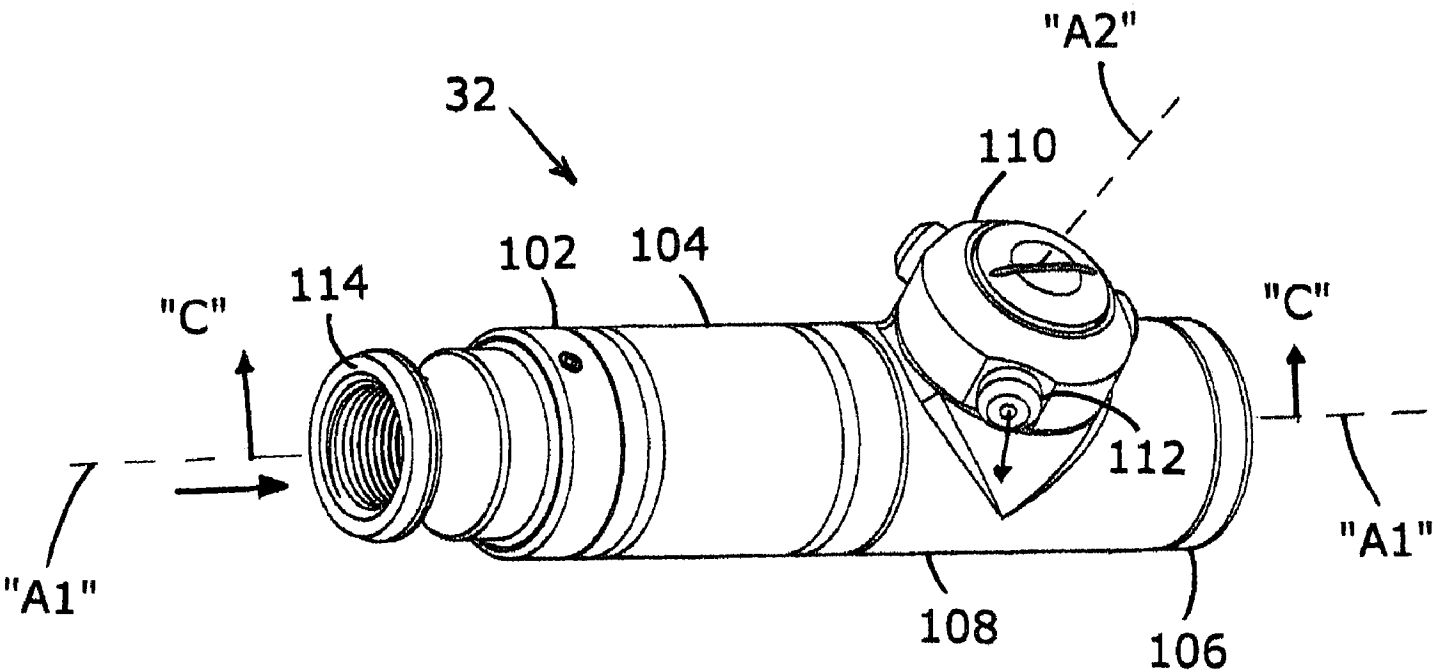
FIG. 8 is a perspective view of the spray device of the system shown in FIGS. 2, 6, and 7.

Once the interior of the enclosure 16 has been cleaned, the spray device 32 can be removed from the stand 36 and mounted on the cover 34 (see FIGS. 4 and 7). The spray device 32 can suspended from the cover 34 by rigid tubing 38 or other suitable means.

The tubing 38 preferably has a bend of approximately 90° formed therein. A first portion 38*a* of the tubing 38 extends downward, through a penetration formed in the cover 34 proximate a center thereof. A second portion 38*b* of the tubing 38 extends outward, toward the periphery of the cover 34. The second portion 38*b* can be secured to the cover 34 by a suitable means such as welding, clamps, etc.

The spray device 32 is mounted on an end of the first portion 38*a*. The spray device 32 and the first portion 38*a* preferably are coupled using quick-disconnect fittings 78. The hose 40 is coupled to an end of the second portion 38*b*, preferably by a quick disconnect fitting 78. The spray device 38 can receive pressurized cleaning fluid from the pumping device 30 by way of the tubing 38, and the flexible hose 40 (see FIG. 2).

The cover 34 is placed on the platform 19 of the restroom facility 12 while the seat 20 and lid 21 are in their respective "up" positions, so that the cover 34 spans the access opening 24. Positioning the cover 34 in this manner causes the spray device 32 to be suspended within the holding tank 22, as depicted in FIG. 7.

The cover 34 preferably has a handle 35 mounted on an upper surface thereof, for ease of handling. Moreover, the cover 34 preferably has a rim 37 formed on a lower surface thereof. The rim 37 engages the edge of the access opening 24, and thereby helps to restrain the cover 34 laterally. The rim 37 also can help to minimize or prevent splashing from the holding tank 22 during cleaning operations. The weight of the cover 34 is believed to be sufficient prevent the cover 34 from moving upward once the cover 34 is placed on the platform 19.

The spray device 32 receives pressurized cleaning fluid from the pumping device 30, at the pressure and flow-rate noted above in relation to the cleaning of the enclosure 16. The spray device 32, upon receiving the pressurized cleaning fluid, generates rotating streams 39 of cleaning fluid in the manner discussed above.

The rotating streams 39 of cleaning fluid are directed against the interior surfaces 22*a* of the holding tank 22. The impact of the streams 39 on the interior surfaces 22*a* can loosen and remove residual waste and other contaminates therefrom. The overall spray pattern produced by the spray nozzles 112 provides essentially 360° coverage around the spray device 32, as noted above. Hence, by suspending the spray device 32 in the holding tank 22 as depicted in FIG. 7, the cleaning fluid can be directed at substantially the entire interior surface of the holding tank 22.

Preferably, the contents of the holding tank 22 are evacuated as the cleaning fluid is introduced therein. Portable restroom facilities such as the restroom facility 12 often are not equipped with drains or other means for evacuating the holding tanks thereof. The system 10 therefore can include provisions to evacuate the holding tank 22 by a vacuum or other suitable means.

For example, the system 10 can include a vacuum wand 62 that extends through a second penetration formed in the cover 34 (see FIGS. 4 and 7). An end of the vacuum wand 62 can be positioned within the holding tank 22, proximate the bottom thereof.

The other end of the vacuum wand 62 is coupled to a flexible hose 64 by a suitable fitting, such as a 90° elbow 66. The hose 64 is connected to a suitable vacuum source 68. The vacuum source 68 can be located, for example, on the vacuum truck 60, although a stand-alone vacuum source can be used in the alternative.

The vacuum source 68 draws the mixture of waste and cleaning fluid from the holding tank 22 of the restroom facility 12. The material evacuated from the holding tank 22 can be deposited in a suitable container, such as a holding tank 64 located on the vacuum truck 60. The material can subsequently be transported to and disposed of at a waste-treatment facility.

The hose 64 preferably is formed from a clear, i.e., substantially transparent, material. This feature permits the operator to monitor the appearance of the stream being evacuated from the holding tank 22. A clearing in the appearance of the stream, and the absence of solid matter therein, can be interpreted by the operator as an indication that the holding tank 22 has been sufficiently cleaned. The pumping device 30 and the vacuum device 68 can be deactivated at this point, the vacuum wand 62 can be pulled out of the holding tank 22, and the cover 34 can be removed from the platform 19.

No operator involvement is required once the cover 34 and the spray device 32 are positioned as shown in FIG. 7, and the pumping device 30 is activated.

Moreover, there is no need for the operator to reach inside or otherwise contact the holding tank 22 to effectuate the cleaning thereof. In addition, the cover 34 can act as a splash guard that further reduces the potential for the operator to come into contact with the waste material in the holding tank 22 during the cleaning process.

The ability of the system 10 to clean substantially the entire interior of the enclosure 16 and the holding tank 22 potentially can result in a more thorough cleaning of the restroom facility 12 than is possible using conventional cleaning methods. Hence, from the perspective of the user, the health risks and unpleasantness associated with unclean restrooms can be substantially reduced or eliminated. Moreover, the need for excessive amounts of disinfectant to compensate for inadequate cleaning also can be eliminated.

The use of the system 10 also can substantially improve the working environment of the individuals performing the cleaning process. For example, operators of the system 10 have minimal or no contact with spray or splash back of the cleaning fluid, waste, or other contaminates associated with the cleaning process. The interior of holding tank 22 can be cleaned without a need for the operator to reach into the holding tank 22 while aiming a hand-held spray device. Moreover, the ability to clean the interior the enclosure 16 while the door 18 is closed substantially reduces or eliminates the potential for spray or splash back from the enclosure 16 to contact the operator.

Hence, the health risks to the operator from contacting residual waste (and the potential regulatory action associated therewith) can be substantially reduced through the use of the system 10. The unpleasantness associated with working inside the restroom facility 12 before it has been cleaned can also be eliminated.

The amount of time required to clean the restroom facility 12 potentially can be reduced using the system 10. For example, it is believed that the interior of the enclosure 16 and the holding tank 22 can each be cleaned in approximately four minutes, once the spray device 32 has been activated. This represents a substantial reduction in the amount of time required to clean the restroom facility 12, in relation to conventional cleaning methods. Hence, the turnaround time needed to prepare the restroom facility 12 for further use can be reduced, potentially increasing revenue for the owner or operator thereof. Moreover, the improved working environment for the individuals performing the cleaning operation potentially can produce further improvements in turnaround times.

The foregoing description is provided for the purpose of explanation and is not to be construed as limiting the invention. While the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Those skilled in the relevant art, having the benefit of the teachings of this specification, may effect numerous modifications to the invention as described herein, and changes may be made without departing from the scope and spirit of the invention as defined by the appended claims.

For example, the holding tank 22 can be cleaned without cleaning the interior or the enclosure 16. Likewise, the interior of the enclosure 16 can be cleaned without cleaning the holding tank 22.

What is claimed is:

1. A system for cleaning a restroom having an enclosure with a seat hingedly mounted to a holding tank, the system comprising:

a pump for pressurizing a fluid;

a spray device in fluid communication with the pump, the spray device comprising a nozzle for discharging a stream of the fluid;

a stand for supporting the spray device within the enclosure of the restroom while the spray device discharges the stream at an interior surface of the enclosure;

a substantially planar cover for closing and isolating an interior of the holding tank and for suspending the spray device in the holding tank of the restroom while the spray device discharges the stream at the interior surface of the holding tank; and a wand for evacuating the fluid from the holding tank while the spray device discharges the stream at the interior surface of the holding tank.

2. The system of claim 1, wherein the wand extends through a penetration formed in the cover.

3. The system of claim 1, further comprising a substantially transparent hose connected on a first end to the wand and connected on a second end to a vacuum source.

4. A system for cleaning a restroom having an enclosure with a seat hingedly mounted to a holding tank, the system comprising:

a pump for pressurizing a fluid;

a spray device in fluid communication with the pump, the spray device comprising a nozzle for discharging a stream of the fluid;

a stand for supporting the spray device within the enclosure of the restroom while the spray device discharges the stream at an interior surface of the enclosure;

a substantially planar cover for closing and isolating an interior of the holding tank and for suspending the spray device in the holding tank of the restroom while the spray device discharges the stream at the interior surface of the holding tank;

tubing secured to the cover, wherein the spray device is suspended from the cover by the tubing and receives the fluid by way of the tubing while the spray device discharges the stream at the interior surface of the holding tank; and a wand for evacuating the holding tank while the spray device discharges the stream at the interior surface of the holding tank, wherein the wand extends through a first penetration in the cover and the tubing extends through a second penetration in the cover so that the fluid can be introduced into and removed from the holding tank simultaneously.

5. A kit for cleaning a restroom, comprising:

a pumping device;

a spray device;

tubing for directing fluid from the pumping device to the spray device;

a cover capable of being installed over an opening in a holding tank of the restroom for substantially closing the holding tank opening and supporting the spray device in the holding tank beneath the cover;

a stand capable of being placed on a surface within an enclosure of the restroom and supporting the spray device in an elevated position within the enclosure; and a vacuum wand for evacuating the fluid from the holding tank.

6. The kit of claim 5, further comprising tubing secured to the cover for suspending the spray device beneath the cover and a vacuum wand for evacuating the holding tank, wherein the vacuum wand extends through a first penetration in the cover and the tubing secured to the cover for suspending the spray device from the cover extends through a second penetration in the cover.

7. The kit of claim 5 further comprising a substantially transparent hose for placing the wand in fluid communication with a vacuum source.

8. A system for cleaning a restroom comprising:

a pump for pressurizing a fluid;

a spray device in fluid communication with the pump, the spray device comprising a nozzle for discharging a stream of the fluid;

a stand for supporting the spray device within an enclosure of the restroom while the spray device discharges the stream at an interior surface of an enclosure;

a cover for suspending the spray device in a holding tank of the restroom while the spray device discharges the stream at an interior surface of the holding tank; and a wand for evacuating the holding tank while the spray device discharges the stream at the interior surface of the holding tank, the wand extending through a penetration formed in the cover.

9. The system for cleaning a restroom described in claim 8, further comprising tubing secured to the cover wherein the spray device is suspended from the cover by the tubing and receives the fluid by way of the tubing.

10. The system for cleaning a restroom described in claim 9, wherein the wand extends through a first penetration in the cover and the tubing extends through a second penetration in the cover so that the fluid can be introduced into and removed from the holding tank simultaneously.

* * * * *